United States Patent [19]

van Wersch et al.

[11] Patent Number: 4,860,399

[45] Date of Patent: Aug. 29, 1989

[54] METHOD OF AND APPARATUS FOR CONDITIONING A TRAVELING TEXTILE FABRIC SUBSTRATE

[75] Inventors: Kurt van Wersch, Wegberg; Klaus Voigt, Moenchengladbach, both of Fed. Rep. of Germany

[73] Assignee: A. Monforts GmbH & Co., Fed. Rep. of Germany

[21] Appl. No.: 226,285

[22] Filed: Jul. 29, 1988

[30] Foreign Application Priority Data

Jul. 31, 1987 [DE] Fed. Rep. of Germany ..... 3725420

[51] Int. Cl.[4] ..... D06B 1/14; D06B 23/00

[52] U.S. Cl. ..... 8/151; 68/4; 68/13 R; 68/202; 118/707

[58] Field of Search ..... 8/151, 151.2; 68/4, 68/9, 13 R, 20, 175, 202, 203; 118/707

[56] References Cited

U.S. PATENT DOCUMENTS

| | | | |
|---|---|---|---|
| 2,960,963 | 11/1960 | Shelton | 68/175 X |
| 2,979,933 | 4/1961 | Gaino | 68/175 X |
| 3,811,834 | 5/1974 | Schwemmer et al. | 68/202 X |
| 4,607,508 | 8/1986 | Sando et al. | 68/175 X |

*Primary Examiner*—Philip R. Coe

*Attorney, Agent, or Firm*—Shefte, Pinckney & Sawyer

[57] ABSTRACT

Applying non-treating liquid to a traveling textile fabric substrate during temporary change-over discontinuance of treating liquor application in a textile treating and drying range with the non-treating liquid being applied in an amount sufficient to approximate the amount of treating liquor applied during normal operation of the range so as to allow the dryer to continue operating at substantially normal operating temperatures without damage to the fabric substrate. A non-treating liquid applicator is shifted between an inoperative position out of the path of the textile fabric substrate into an operative position in engagement with the substrate. The applicator includes a roller for arcuate engagement with the substrate and to which liquid is applied by spray and is uniformly distributed by a squeeze roll acting on a cover on the roller of material capable of retaining and transferring liquid onto the substrate. Fabric guide plates are mounted adjacent to the roller and extend generally tangentially from the roller on opposite sides thereof under the traveling substrate to guide the substrate substantially flat and crease-free as it travels to and from the roller.

13 Claims, 1 Drawing Sheet

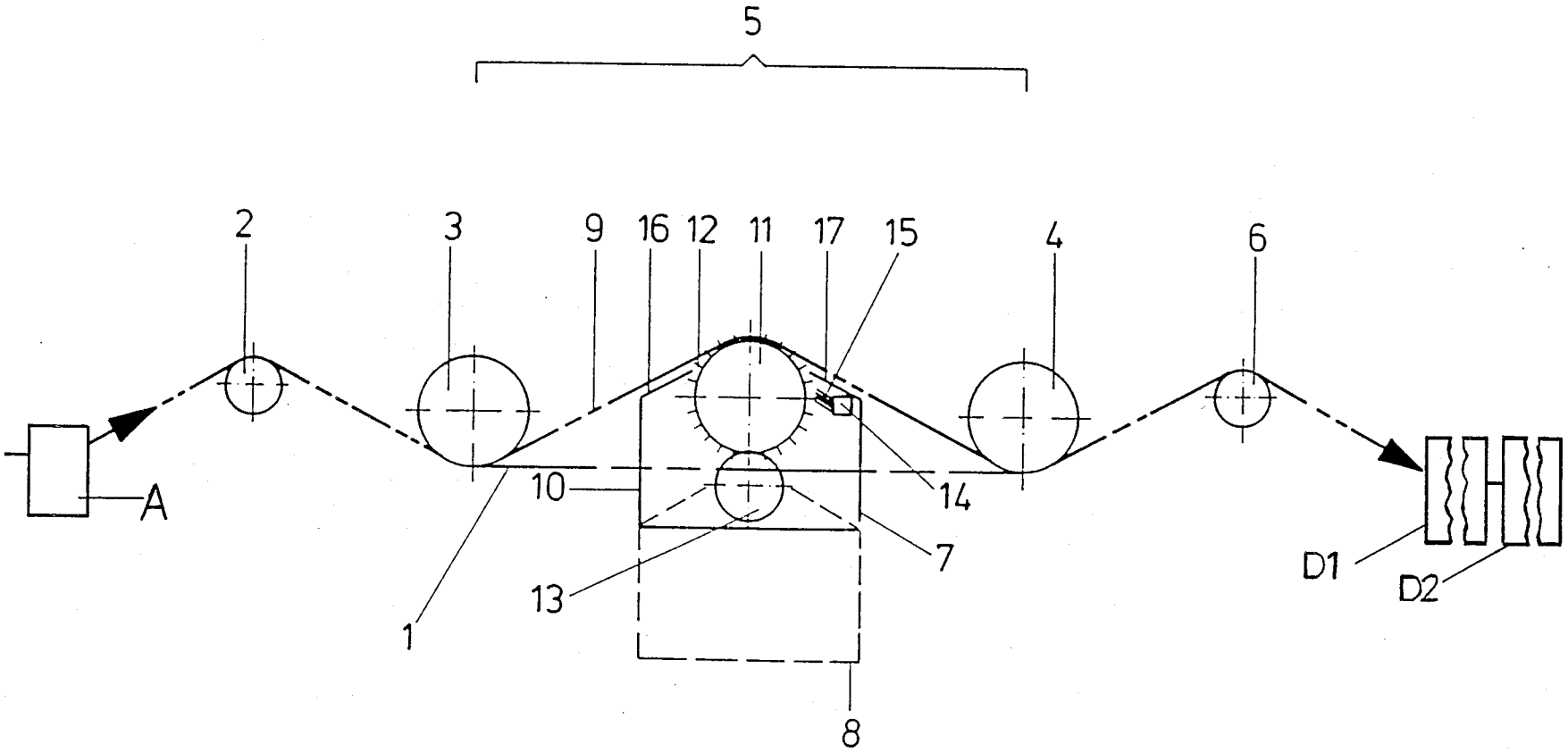
D2
D1
6
4
14
7
15
8
17
5
11
12
16
9
10
13
3
1
2
A

METHOD OF AND APPARATUS FOR CONDITIONING A TRAVELING TEXTILE FABRIC SUBSTRATE

BACKGROUND OF THE INVENTION

The present invention relates to a method of and apparatus for conditioning a traveling textile fabric substrate during temporary change-over discontinuance of treating liquor application in a textile treating and drying range, and more particularly to such a method and apparatus applicable to allow cleaning of liquor from a liquor applicator during a batch change.

Textile fabric treating and drying ranges to which the present invention is applicable conventionally use a dyeing padder or other liquor applicator such as a spray applicator, a foam applicator or a low liquor-ratio applicator followed by a drying oven and/or an infrared preliminary dryer. When there is a batch change, particularly a dye change, it is necessary that the liquor be cleaned from the applicator. This is usually done by first draining the previous liquor from the container of the applicator, such as in a dye back, and replacing the liquor with clear water for cleaning the container, the guide rollers and the squeeze roll unit as well as any other associated components. The guide rollers can also be sprayed and later dried. Usually a cloth lead is sewn to the end of the previously treated fabric substrate and is drawn through the cleaning material. As the cloth lead that has been drawn through the cleaning material is at least as wet as the fabric substrate during the normal treating operation, there is usually no risk of damage to the substrates by allowing the dryer to continue in operation at the normal operating temperature condition.

It is desirable during temporary interruptions of operation that the dryer continue to operate at normal operating temperature because if it is turned off during a batch change and subsequently turned back on, there is a delay required before a steady-state condition is achieved and proper processing results are not obtained during the period of heating to operating temperature. However, during the cleaning of liquor applicators, the equipment must be dried to be sure that all the previous liquor is removed before the applicator and associated container is filled with the new liquor. During this cleaning, an infrared dryer or hot air dryer cannot be allowed to remain at operating temperature as the cloth lead, which is now dry because the applicator is dry, would burn or be damaged from the heat. Dryers can be constructed so that they can be manipulated to direct the heat away from the cloth lead to avoid heat damage, and by-pass passages can be provided to divert hot air away from the fabric, but such solutions require complicated and expensive equipment.

SUMMARY OF THE INVENTION

The purpose of the present invention is to provide a method and apparatus that make it possible to maintain operation of dryers in a textile fabric treating and drying range during batch changes without having to vary the temperature or divert the heat in the dryer. In this way, an infrared dryer or a hot air dryer may continue in operation to apply heat energy needed for drying without the heat having an adverse effect on the cloth leading that is traveling through the equipment during the batch change.

Basically, this purpose is carried out by the method of the present invention of conditioning a traveling textile fabric substrate during temporary change-over discontinuance of treating liquor application in a textile treating and drying range that includes a liquor applicator and a hot air dryer. The method includes applying non-treating liquid, such as water, to the substrate in advance of the dryer independent of the liquor applicator and in an amount sufficient to approximate the amount of treating liquor applied during normal operation of the treating liquor applicator so as to allow the dryer to continue operating at substantially normal operating temperature without damage to the fabric substrate. If there is a preliminary infrared dryer, it also may continue in operation without damaging effect on the traveling substrate.

As the dryer is allowed to continue to operate at normal operating temperature during batch changes, the subsequent fabric substrate to be treated, following the end of the cloth lead, is dried in an immediate steady-state condition without a temperature build-up phase that is normally required with conventional equipment and, therefore, the treatment and drying is uniform from start to finish.

Preferably, the liquid applying method of the present invention is performed between the liquor applicator and the dryer for efficient and simple operation. Also, preferably, the applying of the non-treating liquid is performed using an applicator that is shifted from an inoperative position out of the path of the textile fabric substrate into an operative position in engagement with the substrate.

In the preferred embodiment, the liquid applying is performed with a roller mounted in the applicator for arcuate engagement with the substrate, and the non-treating liquid is sprayed onto the roller for transfer onto the substrate.

The apparatus of the present invention operates to carry out the described method, and for this purpose includes means for applying non-treating liquid to the substrate in advance of the dryer independent of the liquor applicator and in an amount sufficient to approximate the amount of treating liquor applied during normal operation of the treating liquor applicator. Preferably the applying means is located between the liquor applicator and the dryer and is an applicator shiftable from an inoperative position out of the path of the textile fabric substrate into an operative position in engagement with the substrate.

In the preferred embodiment, the liquid applicator includes a roller mounted in the applicator for arcuate engagement with the substrate in combination with means for applying liquid onto the roller for transfer to the substrate. This means for applying liquid onto the roller is preferably means for spraying.

In addition, a squeeze roll is included in engagement with the roller to produce uniform distribution of the liquid on the roller and the roller is formed with a cover of material capable of retaining and transferring liquid from the means for applying liquid onto the roller to the substrate.

To guide the substrate substantially flat as it travels to and from the roller, fabric guide plates are located adjacent the roller and extending generally tangentially from the roller on opposite sides thereof under the traveling substrate.

In an apparatus of this type, the moisture content of the cloth lead can be controlled by the arcuate engagement, or looping angle, with the roller and by the amount of moisture applied to the roller. Alternatively, padder can be used to apply moisture in combination with a squeeze roll unit.

Water is preferably used as the cleaning liquid and is preferably sprayed from nozzles over the entire length of the roller.

The entire apparatus, including the applicator roller, squeeze roll and spray nozzles may be contained in a housing extending transversely to the direction of travel of the substrate and maintained at a distance from the path of the traveling substrate during normal operation. During a batch change and associated cleaning operation, the housing is raised into fabric engagement to create an arched, or looping angle, extent of engagement with the substrate.

The present invention is particularly advantageous in operations where frequent batch changes take place, i.e. for dyeing small batches. In such cases the entire range can continue in operation without undesirable periods of cooling and reheating and resulting delays while equilibrium condition is restored. The present invention, therefore, reduces delays and achieves better quality production because there is no difference in the treatment at the beginning of a run due to heat up from a cool condition.

BRIEF DESCRIPTION OF THE DRAWING

The accompanying drawing is a schematic side elevation of the apparatus of the present invention serving as a portion of a textile treating and drying range.

DETAILED DESCRIPTION OF THE PREFERRED EMBODIMENT

In the accompanying drawing, a textile fabric substrate 1 travels from left to right in the direction of the arrow and is progressing from, for example, a padder A over a guide roller 2 to a liquid applying zone 5 bounded by two guide rollers 3 and 4. The fabric 1, after leaving the liquid applying zone 5 passes over another guide roller 6 to a preliminary infrared dryer D1 and a hot air dryer D2. As the padder or other treating liquor applicator A, and the dryers D1 and D2 are conventional items of a treating and drying range, there is no need for any detailed illustration or description.

In the liquid applying zone 5, a housing 7 is normally located out of the path of the traveling substrate, which location is indicated by the reference numeral 8, under the path of the substrate 1. Thus, the traveling substrate does not come in contact with the liquid applicator of the present invention during normal treating and drying operation. Rather, the substrate travels straight between the guide rollers 3 and 4.

When a dye change or other batch change is to be performed, the substrate that is treated is replaced by a substrate in the form of a cloth lead sewn to the end of the preceding fabric substrate to provide a continuing substrate traveling through the range during the batch change. As long as the liquor applic;ator contains liquor, the cloth lead is wetted in the normal operating manner.

However, when the treating liquor is to be changed and the liquor applicator cleaned, the cloth lead 9 is not wetted by the liquor applicator and, if it were not for the present invention, would be subject to the risk of damage by overheating in the downstream dryers. To avoid this problem, the housing 7 of the apparatus of the illustrated embodiment of the present invention is shifted during this otherwise dry traveling condition of the cloth lead 9 into the path of the substrate in the liquid applying zone 5 so that the cloth lead 9 travels in an arched, or looping angle, condition over the housing 7. The housing 7 in the shifted position shown in solid lines 10 has mounted at its top a roller 11 with a cover 12 of material capable of retaining and transferring liquid onto the substrate. Mounted within the housing is spraying means 14 in the form of nozzles extending along the length of the roller 11 for spraying water 15 onto the cover 12 of the roller. A squeeze roll 13 is mounted below the applicator roller 11 to apply squeezing pressure to the cover 12 on the roller 13 to produce uniform distribution of the water on the roller 11.

The housing 11 includes fabric guide plates 16 and 17 adjacent the roller 11 and extending generally tangentially from the roller 11 on opposite sides thereof under the traveling substrate 9 to guide the substrate substantially flat as it travels to and from the roller 11. These guide plates 16 and 17 are generally parallel with the adjacent path of travel of the cloth lead 9 and will cause the cloth lead to be guided in a smooth and practically crease-free condition to the roller 11 and conducted in the same smooth condition from the roller 11 to the following guide roller 4. Further, the guide plates 16 and 17 serve as deflectors to prevent splashing of the water from the sprayer 14 directly onto the substrate. The housing 11 further serves to prevent dripping of sprayed water onto adjacent equipment.

It will therefore be readily understood by those person skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of conditioning a traveling textile fabric substrate during temporary change-over discontinuance of treating liquor applications in a textile treating and drying range that includes a liquor applicator and a dryer, said method comprising applying non-treating liquid to the substrate in advance of the dryer independent of the liquor applicator and in an amount sufficient to approximate the amount of treating liquor applied during normal operation of the treating liquor applicator so as to allow the dryer to continue operating at substantially normal operating temperature without damage to the fabric substrate.

2. A method of conditioning a traveling textile fabric substrate according to claim 1 and characterized further in that said liquid applying is performed between the liquor applicator and the dryer.

3. A method of conditioning a traveling textile fabric substrate according to claim 2 and characterized further in that said non-treating liquid applying is performed using an applicator and includes shifting said applicator from an inoperative position out of the path of the textile fabric substrate into an operative position in engagement with the substrate.

4. A method of conditioning a traveling textile fabric substrate according to claim 3 and characterized further in that said non-treating liquid applying is performed with a roller mounted in the applicator for arcuate engagement with the substrate.

5. A method of conditioning a traveling textile fabric substrate according to claim 4 and characterized further in that said non-treating liquid applying includes spraying the non-treating liquid onto the roller for transfer onto the substrate.

6. Apparatus for conditioning a traveling textile fabric substrate during temporary change-over discontinuance of treating liquor application in a textile treating and dyeing range that includes a liquor applicator and a dryer, said apparatus comprising means for applying non-treating liquid to the substrate in advance of the dryer independent of the liquor applicator and in an amount sufficient to approximate the amount of treating liquor applied during normal operation of the treating liquor applicator so as to allow the dryer to continue operating at substantially normal operating temperature without damage to the fabric substrate.

7. Apparatus for conditioning a traveling textile fabric substrate according to claim 6 and characterized further in that said applying means is located between the liquor applicator and the dryer.

8. Apparatus for conditioning a traveling fabric substrate according to claim 7 and characterized further in that said applying means comprises an applicator shiftable from an inoperable position out of the path of the textile fabric substrate into an operative position in engagement with the substrate.

9. Apparatus for conditioning a traveling textile fabric substrate according to claim 8 and characterized further in that said applicator includes a roller mounted in the applicator for arcuate engagement with the substrate, and means for applying liquid onto said roller for transfer to said substrate.

10. Apparatus for conditioning a traveling textile fabric substrate according to claim 9 and characterized further in that said means for applying liquid onto said roller comprises means for spraying non-treating liquid onto said roller.

11. Apparatus for conditioning a traveling textile fabric substrate according to claim 8 or 9 and characterized further in that said applicator includes a squeeze roll in engagement with said roller to produce uniform distribution of the liquid on the roller.

12. Apparatus for conditioning a traveling textile fabric substrate according to claim 9 or 10 and characterized further in that said roller is formed with a cover of material capable of retaining and transferring liquid from said means for applying liquid onto said roller to said substrate.

13. Apparatus for conditioning a traveling textile fabric substrate according to claim 9 or 10 and characterized further in that said applicator includes fabric guide plates adjacent said roller and extending generally tangentially from said roller on opposite sides thereof under the traveling substrate to guide the substrate substantially flat as it travels to and from said roller.

* * * * *